US009506234B2

(12) United States Patent
Files, Jr.

(10) Patent No.: US 9,506,234 B2
(45) Date of Patent: Nov. 29, 2016

(54) TRENCH DRAIN

(71) Applicant: Rapid Trench, LLC, Vancouver, WA (US)

(72) Inventor: Patrick T. Files, Jr., Vancouver, WA (US)

(73) Assignee: Rapid Trench, LLC, Vancouver, WA (US)

( * ) Notice: Subject to any disclaimer, the term of this patent is extended or adjusted under 35 U.S.C. 154(b) by 0 days.

(21) Appl. No.: 14/699,798

(22) Filed: Apr. 29, 2015

(65) Prior Publication Data

US 2016/0319530 A1 Nov. 3, 2016

(51) Int. Cl.

| | |
|---|---|
| ***E03F 1/00*** | (2006.01) |
| ***E03F 3/04*** | (2006.01) |
| ***E03F 5/04*** | (2006.01) |

(52) U.S. Cl.

CPC . *E03F 3/04* (2013.01); *E03F 1/00* (2013.01); *E03F 5/041* (2013.01); *E03F 2005/0413* (2013.01); *E03F 2005/0415* (2013.01)

(58) Field of Classification Search

CPC ..... E03F 1/00; E03F 3/04; E03F 5/041; E03F 2005/0413; E03F 2005/0415

USPC ..... 404/2–4

See application file for complete search history.

(56) References Cited

U.S. PATENT DOCUMENTS

| | | | | |
|---|---|---|---|---|
| 5,522,675 | A * | 6/1996 | Gunter | E03F 3/046 24/336 |
| 5,971,662 | A * | 10/1999 | Becker | E03F 3/046 404/2 |
| 6,004,068 | A * | 12/1999 | Hosley | E02D 17/00 249/10 |
| 6,860,678 | B2 | 3/2005 | Gunter | |
| 2002/0057945 | A1* | 5/2002 | Dahowski | E01C 11/227 405/118 |
| 2003/0082009 | A1* | 5/2003 | Humphries | E03F 3/046 405/118 |
| 2004/0062602 | A1* | 4/2004 | Dahowski | E04H 4/1227 404/2 |
| 2004/0136785 | A1* | 7/2004 | Gunter | E03F 3/046 405/118 |
| 2005/0025567 | A1* | 2/2005 | Bricker | E03F 3/046 404/2 |
| 2006/0159515 | A1* | 7/2006 | Messerschimidt | E03F 5/06 404/4 |
| 2006/0239773 | A1* | 10/2006 | Meyers | E03F 3/046 404/2 |
| 2015/0308092 | A1* | 10/2015 | Chromey | E03F 3/046 137/363 |

* cited by examiner

*Primary Examiner* — Raymond W Addie

(74) *Attorney, Agent, or Firm* — Klarquist Sparkman, LLP

(57) ABSTRACT

A device for a trench drain system includes an elongate frame, and the elongate frame is configured to detachably connect to a plurality of channel sections, to longitudinally and laterally align each channel section of the plurality of channel sections with adjacent channel sections, and to interconnect the plurality of channel sections such that the plurality of channel sections is moveable as a single unit.

17 Claims, 9 Drawing Sheets

TRENCH DRAIN

FIELD

The present disclosure generally concerns trench drain systems and devices and related methods for installing such systems.

BACKGROUND

Trench drains are typically used where there is a need to drain a generally flat surface, such as a sidewalk, driveway, overhead or garage door opening, factory floor, airport apron, or roadway median. Trench drains collect liquid runoff and deliver the runoff to a collection system, such as a sewer system. Typically, trench drains are U-shaped or V-shaped channels or troughs. A grate is placed over the channel to prevent large debris, people, and/or other objects from falling into the channel.

Historically, trench drains were cast-in-place by pouring concrete into forms which were built within a trench. These cast-in-place trench drains are costly and labor extensive due to the forming process.

In recent years, however, trench drain systems are typically modular. These modular systems are typically formed from pre-cast, one-meter channel sections which are assembled on-site to form a desired length or run. Modular trench drain systems provide many advantages over cast-in-place trench drain systems, such as reduced production cost, transportability, and uniformity of design. Despite these advantages, typical modular trench drains systems present challenges of their own, especially during the installation process.

During a typical installation process, a trench is dug to a depth of approximately two times the depth of the channel section. An anchoring and channel support system is then assembled within the trench to desirably position the channel sections within the trench. The anchoring systems typically comprise stakes which are inserted into and distributed throughout the trench, and the support systems typically comprise brackets which are used to connect channel sections to adjacent stakes. Generally, there are at least two stakes (i.e., one on each side) and at least one bracket per channel section, plus an additional set of stakes and a bracket at the end of the run. Each channel section is then transported to and placed on a respective bracket within the trench, and the channel sections are then connected to each other in an end-to-end manner. Each channel section then has to be leveled and aligned relative to both the trench and the other channel sections.

Once the channel sections are positioned and leveled, the channel sections must be covered to prevent concrete from spilling into the channels during the pour. This is typically done by covering the channels with oriented strand board (OSB). Following the pour, the cover is removed, and the grating is installed.

This process can be very labor intensive, requiring multiple workers to work for many hours to complete the installation. For example, a typical installation of a one hundred foot run can require more than sixty hours of labor (e.g., four full-time days for two workers). In addition, the process consumes valuable materials (e.g., the anchors, brackets, and OSB) to secure the sections in place until the trench drains have been permanently secured in place. These materials are non-reusable because concrete is poured around them.

Thus, there is a continuing need for improved modular trench drain systems, as well as methods for installing such trench drain systems.

SUMMARY

Described herein are embodiments of trench drain systems and components thereof that are primarily intended to be used with modular trench drain systems, as well as methods for installing the same. These trench drain systems can significantly improve the efficiency of modular trench drain installation. The trench drain systems can comprise frames and brackets, which are configured to connect and align a plurality of modular channel sections both relative to each other and to the trench in which the system is disposed.

In one representative embodiment, a trench drain system comprises an elongate frame wherein the elongate frame is configured to detachably connect to a plurality of channel sections, to longitudinally and laterally align each channel section of the plurality of channel sections with adjacent channel sections, and to interconnect the plurality of channel sections such that the plurality of channel sections is moveable as a single unit.

In some embodiments, the plurality of channel sections is a first plurality of channel sections, and the elongate frame is configured to extend longitudinally from an end of the first plurality of channel sections such that the elongate frame can be detachably connected to at least one additional channel section of a second plurality of channel sections to form a tongue-and-groove-type joint between the first and the second plurality of channel sections.

In some embodiments, the elongate frame is configured to extend laterally between a first interior edge and a second interior edge of each channel section of the plurality of channel sections. In some of those embodiments, the first interior edge is an edge of first integrated rail, and the second interior edge is an edge of a second integrated rail and wherein the elongate frame comprises inner frame rails and outer frame rails which are together configured to fit over the first interior edge of the first integrated rail and the second interior edge of the second integrated rail.

In some embodiments, the elongate frame is configured to be closed on a first surface such that an upper opening of each channel section of the plurality of channel sections is substantially sealed. In some embodiments, the plurality of channel sections comprises five or less channel sections. In some embodiments, a plurality of fasteners is provided, and each of the fasteners of the plurality of fasteners extend through a primary opening of the elongate frame and releasably connect the elongate frame to respective channel sections.

In another representative embodiment, a trench drain system comprises a support bracket. The support bracket can comprise a support member configured to support at least a portion of a trench drain channel section, a first positioning member, wherein the first positioning member is configured to adjustably move and secure the at least a portion of a trench drain channel section in a first direction relative to at least one anchor, and a second positioning member configured to adjustably move and secure the at least a portion of a trench drain channel section in a second direction relative to the at least one anchor.

In some embodiments, the first positioning member is slidably and/or rotatably connected to the support member. In some embodiments, the support member includes at least one laterally extending groove along which the first positioning member can slide and/or rotate.

In some embodiments, the first positioning member comprises a macro adjustment mechanism and/or a micro adjustment mechanism which are each configured to adjustably move and secure the at least a portion of a trench drain channel section in the first direction relative to at least one anchor.

In some embodiments, at least a portion of a trench drain channel section directly contacts both the support member and the first positioning member. In some embodiments, the support bracket is configured to attach to an upper portion of the trench drain channel section.

In some embodiments, the second positioning member is fixedly secured to the support member. In other embodiments, the second positioning member is detachably connected to the support member. In some embodiments, the support member and at least a portion of the second positioning member are integrally formed from a single piece of material.

In some embodiments, the first direction is substantially parallel to a plane of the ground adjacent to the support bracket and the second direction is substantially perpendicular to the plane of the ground adjacent to the support bracket.

In another representative embodiment, a trench drain system comprises a plurality of channel sections, wherein the channel sections each comprise a trough having a top opening which is disposed between upper edges which extend longitudinally along each side of the channel sections, an elongate frame, wherein the elongate frame comprises a substantially closed upper surface which is configured to extend longitudinally over one or more of the channel sections and to extend laterally between the upper edges of the channel sections such that the top opening of the trough is covered, and one or more support brackets having a first positioning member and a second positioning member, wherein the first positioning member includes both a macro and a micro adjustment mechanism which are each configured to move and secure at least a portion of one of the channel sections in a first direction, and wherein the second positioning member is configured to move and secure the at least a portion of one of the channel sections in a second direction.

In some embodiments, the channel sections further comprise a cross-brace which is configured to receive a fastener which extends to the cross-brace from the elongate frame. In some embodiments, the elongate frame further comprises laterally spaced-apart, longitudinally extending outer rails, laterally spaced-apart, longitudinally extending outer rails which are disposed between the outer rails, and a plurality of primary openings in the upper surface, the primary opening being configured to receive a fastener. In some embodiments, the support bracket further comprises a main support member having a groove in which the first positioning member slide along.

In another representative embodiment, a method of aligning a second trench drain channel section relative to an adjacent first trench drain channel section is provided. The method comprises positioning the second trench drain channel section on one or more support brackets in an initial position generally in a longitudinal line with adjacent first trench drain channel section, moving the second trench drain channel section in a first direction from the initial position to a first position by adjusting a macro adjustment mechanism of the one or more support brackets such that the second trench drain channel section substantially aligns with the adjacent first channel section in a longitudinal line, moving the second trench drain channel section in the first direction from the first position to a second position by adjusting a micro adjustment mechanism of the support bracket such that the second trench drain channel section more precisely aligns in a longitudinal line with adjacent first trench drain channel section in in a longitudinal line with adjacent first trench drain channel section.

The foregoing and other objects, features, and advantages of the invention will become more apparent from the following detailed description, which proceeds with reference to the accompanying figures.

DETAILED DESCRIPTION

Figure 1:
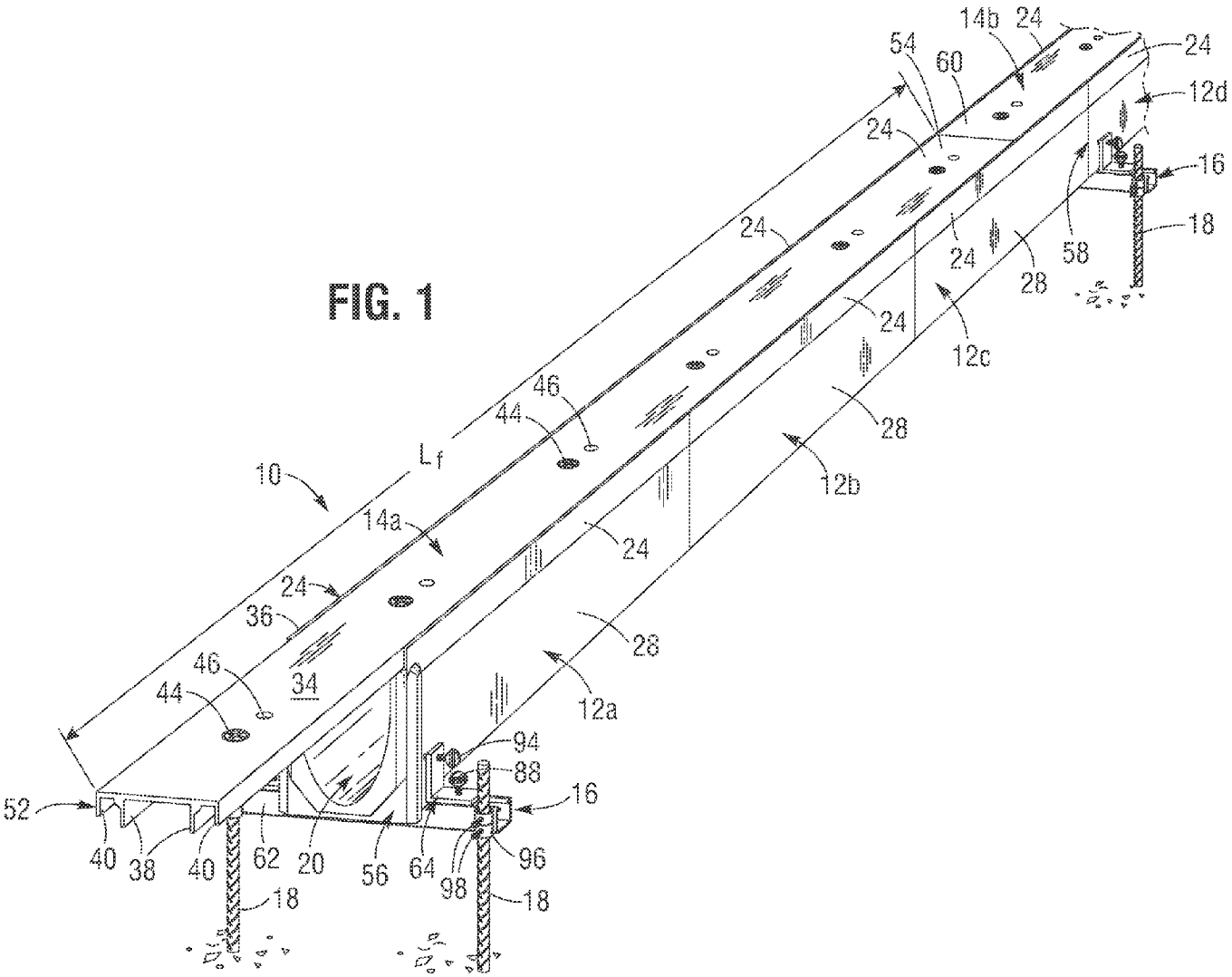
FIG. 1 is a perspective view of an exemplary trench drain system, according to one embodiment.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

As used herein, the term "coupled" generally means physically coupled or linked and does not exclude the presence of intermediate elements between the coupled items absent specific contrary language.

Described herein are embodiments of trench drain systems and components thereof that are primarily intended to be used with modular trench drain systems, as well as methods for installing the same. These trench drain systems can significantly improve the efficiency of modular trench drain installation. The trench drain systems can comprise frames and brackets, which are configured to connect and align a plurality of modular channel sections both relative to each other and to the trench in which the system is disposed.

In particular embodiments, a trench drain system can comprise an elongate frame which is configured to be detachably connected to a plurality of channel sections, to longitudinally and laterally align each channel section of the plurality of channel sections with adjacent channel sections along a longitudinal axis, and to interconnect the plurality of channel sections such that the plurality of channel sections is moveable as a single unit.

In particular embodiments, a trench drain system can comprise a channel support system which includes a support member configured to support at least a portion of a trench drain channel section and to allow the channel section to be adjustably moveable in multiple directions. This allows the channel section to be aligned relative to both the trench and adjacent channel sections.

In a particular embodiment, the channel support system includes a first positioning member, wherein the first positioning member includes both a macro and a micro adjustment mechanism which are each configured to move and secure the at least a portion of a trench drain channel section in a first direction relative to at least one anchor, and a second positioning member configured to move and secure the at least a portion of a trench drain channel section in a second direction relative to the at least one anchor.

FIG. 1 shows an exemplary trench drain system 10, according to one embodiment. The trench drain system 10 comprises a plurality of channel sections 12 (four, 12*a*-12*d*, in the illustrated embodiment), at least one frame 14 (two, 14*a* and 14*b*, in the illustrated embodiment), a plurality of channel support brackets 16 (two in the illustrated embodiment), and a plurality of anchors 18 (four in the illustrated embodiment). The frames 14 can be used to interconnect, align, and support a respective plurality of channel sections (e.g., 12*a*, 12*b*, 12*c*) relative to each other, as well as to interconnect and align the respective plurality of channel sections relative to an adjacent channel section and/or an additional plurality of channel sections (e.g., 12*d*). The frames 14 can also be used to cover or partially cover a portion of the channel sections 12. The channel support brackets 16 can be used to connect the channel sections 12 to the anchors 18 and to align and position the channel sections 12 relative to a trench and/or the ground. The anchors 18 can be used to secure the positioning of the support brackets 16 relative to the ground. Each of these components, as well as their interaction together, is further described below.

The channel sections 12 can be pre-cast or modular-type channel sections which can be assembled on-site in an end-to-end manner to form a desired length. The channel sections 12 can comprise various lengths, widths, heights, trough shapes and dimensions, etc. The channel sections 12 can be formed from various materials, including concrete and/or lightweight, polymeric materials, such as High Density Polyethylene (HDPE). The channel sections 12 can, for example, be commercially available channel sections such as the KLASSIKDRAIN channels (e.g., the K200 channels), manufactured by ACO Polymer Products, Inc.

Figure 2:
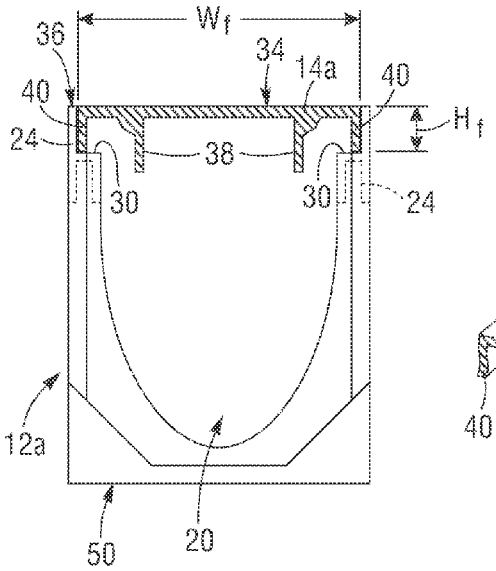
FIG. 2 is an end view of a channel section and a cross-sectional view of a frame of the trench drain system of FIG. 1.
Figure 3:
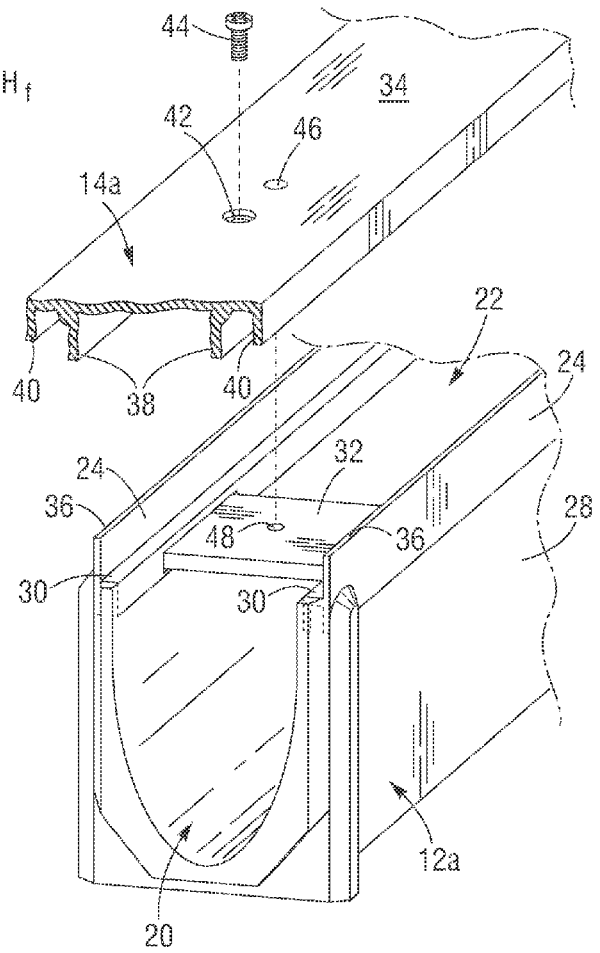
FIG. 3 is an exploded, perspective view of the channel and the frame of FIG. 2.

In the illustrated embodiment, for example, the channel sections 12 each comprise a trough 20. The troughs 20 can each include a top opening 22, which is configured to receive liquid runoff, as best shown in FIG. 3. As also best shown in FIG. 3, the channel sections 12 can each further comprise an integrated rail 24 disposed on each of the upper edges 36 of the sides 28 of the channel sections 12. The integrated rails 24 can each have a lip 30 which extends laterally inward towards each other from the sides 28. The lips 30 can, for example, be used to support a respective frame 14, as best shown in FIG. 2. Each channel section 12 can also comprise at least one cross-brace 32 (FIG. 3) which extends from the sides 28 across the trough 20. The cross-brace 32 can, for example, be used to connect the channel sections 12 to a respective frame 14, as further described below.

The frames 14 can be elongate, rigid beams or rods. The frames can comprise various dimensions to accommodate a desired channel size, style, and/or number of channels. For example, the frames 14 each comprise a width $W_f$ (FIG. 2) such that the frames 14 can be disposed between the integrated rails 24 and rest on the lips 30 of the channel sections 12, as best shown in FIG. 2. In the embodiment shown in FIG. 2, the frame 14*a* fits snugly between the rails 24 and is held in place at least partially by a frictional fit between the frame 14*a* and the rails 24. The frames 14 can, for example, comprise a length $L_f$ (FIG. 1) such that the frames 14 can span at least a portion of a plurality of channel sections 12. The frames can span more or less channel sections than shown in the exemplary embodiment. In the embodiment illustrated in FIG. 1, for example, the frame 14*a* spans channel sections 12*a*-12*c*, plus an additional channel section (not shown) which can be added, as further described below. The frames 14 can, for example, comprise a height $H_f$ (FIG. 2). The height $H_f$ can, for example, be configured such that a first surface 34 (the upper surface in the illustrated embodiment) of the frames 14 can be flush with the upper edges 36 of the channel sections 14, as best shown in FIG. 2.

It should be noted that the dimensions of the frames 14 are scalable to accommodate various channel sizes, styles, and/ or desired number of channels to be interconnected. For example, in some embodiments, the width $W_f$ can be about 50 mm to about 1000 mm, the length $L_f$ can be about 0.5 m to about 10 m, and the height $H_f$ can be about 10 mm to about 80 mm. In other exemplary embodiments, the width $W_f$ can be about 100 mm to about 500 mm, the length $L_f$ can be about 1 m to about 4 m, and the height $H_f$ can be about 20 mm to about 55 mm. In one particular embodiment, the width $W_f$ is about 200 mm, the length $L_f$ is about 3 m, and the height $H_f$ is about 25 mm.

It will be appreciated by one of ordinary skill in the art that the frames can comprise various cross-sectional shapes, such as U-shaped, W-shaped, rectangular, etc. based on the type of channel sections with which the frames are to be used. For example, the frames 14 comprise a generally W-shaped cross-sectional shape, as best shown in FIG. 2. The generally W-shaped frames 14 include laterally spaced apart and longitudinally extending frame rails, including inner frame rails 38 and outer frame rails 40. The frame rails 38, 40 can increase the rigidity and strength to the frames 14 such that the frames 14 can be used to interconnect and/or transport a plurality of channel sections 12, as further described below.

It will also be appreciated by one of ordinary skill in the art that the frames 14 can be formed from various types of material (e.g., steel, aluminum, polymeric, etc.) suitable for the particular application. In specific embodiments, the frames are steel. The frames 14 can also comprise a coating or treatment (e.g., galvanization, painting, etc.) to prevent or eliminate corrosion such that the frames 14 will not become damaged when exposed to the elements.

With reference to FIG. 1, the frames 14 can be configured to obstruct the top openings 22 of the channel sections 12. This can prevent debris (e.g., dirt, excess concrete, etc.) and other objects (people, equipment, etc.) from falling into the top openings 22. This can be accomplished, for example, by forming the first surface 34 as a substantially solid surface (as best shown in FIG. 1). Once installation and/or construction are complete, the frames 14 can be removed and grating can be installed.

In alternative embodiments, the first surface 34 of each frame can comprise a plurality of openings (e.g., similar to a traditional grate). The openings can be covered by a temporary cover (not shown) which is detachably connected to the first surface 34. The cover can remain in place during the installation and/or construction and can then be removed, leaving the frame in place as the grate. The covers can be attached to the frames by fasteners, an adhesive, etc. and can be formed from various materials such as metals, polymers, etc.

The frames 14 can be detachably connected to respective channel sections 12 in various ways. For example, in the illustrated embodiment, the frames 14 can comprise a plurality of primary openings 42, as best show in FIG. 3. The primary openings 42 can be disposed along the first surface 34 of the frame 14 such that each primary opening 42 longitudinally and laterally aligns with a respective cross-brace 32 of a channel section 12. As such, the fasteners 44 can be inserted through respective primary openings 42 and into the respective cross-braces 32 (having fastener openings 48), thereby detachably connecting the frames 14 to the respective channel sections 12. The fasteners may include screws, bolts, etc.

As shown in FIG. 3, the frames 14 can also comprise secondary openings 46 which are disposed adjacent to respective primary openings 42. The secondary openings 46 can be used as "sight-holes" which allow a user to quickly align the primary openings 42 with the cross-braces 32 even when the fasteners 44 are inserted in the primary openings 42.

In some embodiments, the cross-braces 32 can each comprise a fastener opening 48 (FIG. 3), which corresponds to the respective primary openings 44 of the frame 14, and is configured to receive the fasteners 44. In alternative embodiments, the cross-braces 32 can be void of the openings 48, and an appropriate fastener 44 (e.g., a self-tapping screw) can be selected that can fasten to the cross-brace 32 without need for a pre-made or pilot-type opening.

In alternative embodiments, the frames 14 can be configured such that the frames can be detachably connected to other portions of the channel sections 12 and/or in various ways. For example, the frames 14 can be detachably connected to the side surfaces 28, a bottom surface 50 (FIG. 2), or the integrated rails 24 of the respective channel sections 12.

When configured in the manner just described, the frames 14 allow channel sections 12 to be pre-assembled and then moved, transported, and/or positioned as a single unit. As such, less labor is required to install a drain because fewer trips are required to move a specific number of channel sections to the desired installation location, and/or it is easier to carry multiple channel sections 12 at a time. The frames 14 also significantly saves valuable time because the channel sections 12 can be aligned and connected more efficiently at a warehouse, factory, distribution center, or any other location that is more convenient and/or less confined than a trench or installation site.

It should be noted, however, that the frames 14 can be connected to the channel sections 12 at any time, including once the channel sections are in the trench. The frames 14 would still provide significant labor savings by eliminating the need to secure and level each individual channel section at a time.

In addition, the frames 14 reduce the number of anchors and/or support brackets required for the installation process because the frames 14 align and support the channel sections independently. For example, typical trench drain systems (i.e., systems without a frame 14) would require eight anchors (i.e., two per channel section, plus two at the end) and four support brackets (i.e., one per channel section, plus one) to support three channel sections. However, by including a frame 14, the trench drain system 10 illustrated in FIG. 1 only requires four anchors 18 (i.e., two per three channel sections, plus two) and two support brackets 16 (i.e., one per three channel sections, plus one at the end). Thus, the frames 14 significantly reduce both the cost of labor and material.

The frames 14 also provide significant environmental benefits by reducing the amount of raw material consumed during each installation process. These significant benefits are available because the reusable frames 14 reduce the non-reusable components of drain installation, such as the anchors and/or support brackets. The frames also replace typical temporary covers, usually made of oriented strand board (OSB), which are placed over the channel sections during installation and/or construction and later replaced by the permanent grating. These OSB covers can sometimes be reused a few times, but they can quickly become damaged. Once damaged, the OSB is discarded, requiring new covers to be made. The frames 14, on the other hand, can be reused many times, due to their durable nature.

Configuring the frames 14 as described also allows the frames to form tongue-and-groove-type connections with adjacent channel sections. These tongue-and-groove connections allow multiple pluralities of channel sections which are each connected by respective frames 14 to be quickly aligned with and connected to each other during the installation process. These connections can formed by detachably connecting a frame 14 to a plurality of channel sections in a longitudinally offset manner.

For example, as shown in FIG. 1, a first end 52 and a second end 54 (i.e., the second end being opposite from the first end) of the frame 14*a* do not longitudinally align with a first end 56 of the channel section 12*a* and a second end 58 of the channel section 12*c*. Rather, the first end 52 of the frame 14*a* extends longitudinally beyond the first end 56 of the channel section 12*a*, and the second end 54 of the frame 14*a* only extends longitudinally to about a midpoint (i.e., short of the second end 58) of channel section 12*c*, as shown in FIG. 1. As such, the portion of the frame 14*a* that extends longitudinally beyond channel section 12*a* forms a "tongue," and the portion of the channel section 12*c* that is not covered by the frame 14*a* forms a "groove." In this manner, the frame 14*a* can extend over and be detachably connected to an additional channel section (not shown), and a first end 60 of the frame 14*b* can extend over and be detachably connected to the channel section 12*c*. Thus, the frames 14*a* and 14*b* interconnect and align the channel sections which are connected to the respective frames.

Once a plurality of channel sections 12 (e.g., channel sections 12*a*-12*c*) is connected by a frame 14, the channel sections 12 can be connected to a support bracket 16, as shown in FIG. 1. The support brackets 16 can be connected to the anchors 18 which are disposed in a trench or other location in which the trench drain system is being installed.

Figure 4:
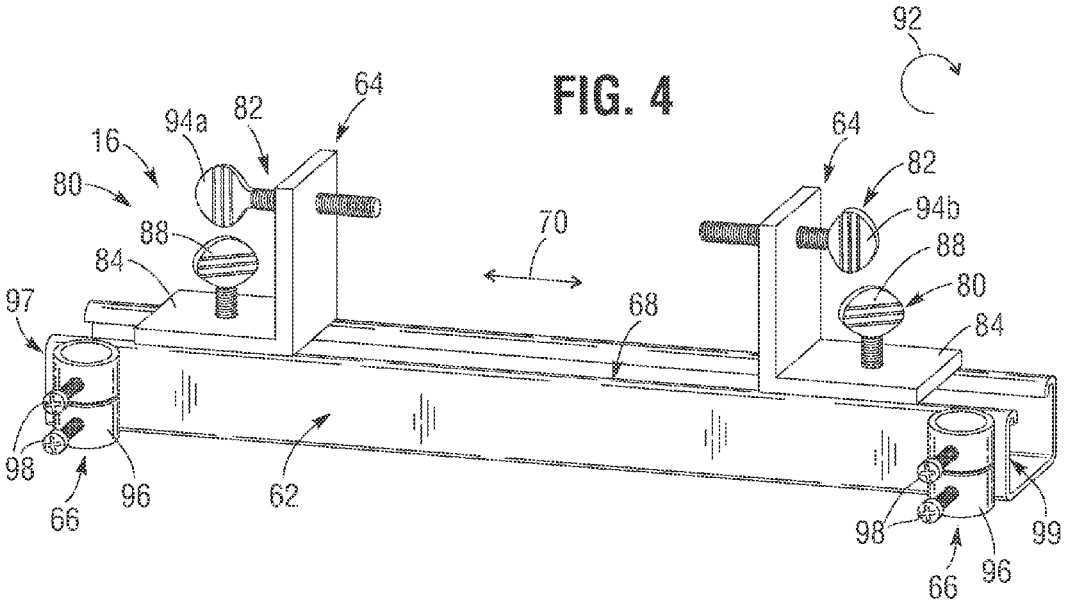
FIG. 4 is a perspective view of a channel support bracket of the trench drain system of FIG. 1.

With reference to FIG. 4, the support brackets 16 can each comprise a main support member 62, at least one first positioning member 64 (two in the illustrated embodiment), and a plurality of second positioning members 66 (two in the illustrated embodiment). The first positioning members 64 can each be detachably, slidably, and/or rotatably connected to the main support member 62, and the second positioning members 66 can each be fixedly secured or coupled to the main support member 62, as further described below.

Figure 5:
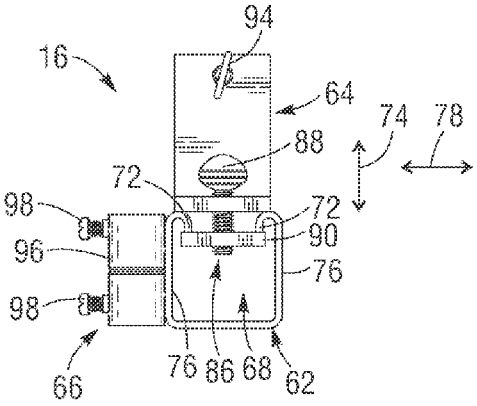
FIG. 5 is an end view of the channel support bracket of FIG. 4.

The main support member 62 can comprise an elongate slot or groove 68 through which the first positioning members 64 can be slidably and/or rotatably connected to the main support 62. The main support 62 can be configured such that the first positioning members 64 can slide within the groove 68 in a first direction (e.g., in the direction shown by arrow 70 in the illustrated embodiment) relative to both the main support 62 and each other. The main support 62 can also be configured to prevent the first positioning members 64 substantially moving or sliding in other directions. For example, in the illustrated embodiment, the main support 62 comprises rails or lips 72 which prevent the first positioning members 64 from moving vertically (i.e., in the direction shown by arrow 74) and side members 76 which prevent the first positioning members 64 from moving laterally (i.e., in the direction shown by arrow 78), as best shown in FIG. 5.

The main support 62 can be formed from various materials, including steel, aluminum, polymers, etc. In one specific embodiment, the main support 62 is formed from steel. The main support member 62 can comprise various dimensions to correspond to a particular channel section size or range of sizes with which the support bracket 16 is to be used.

The main support 62 can, for example, be formed from an elongate tube, channel, plate, etc. For example, as shown in the illustrated embodiment, the main support 62 can be formed from strut channel.

The first positioning members 64 can each comprise a macro adjustment mechanism 80 and a micro adjustment mechanism 82, as best shown in FIG. 4. The macro adjustment mechanisms 80 can each be detachably, slidably, and/or rotatably connected to the main support 62, and the micro adjustment mechanisms 82 can each be adjustably connected to a respective macro adjustment mechanism 80, as further described below. As shown in FIG. 1, the first positioning members 64 can be used to secure a respective channel section 12 to a respective support bracket 16 and/or to position the channel section 12 relative to the support bracket 16 and thus the anchors 18 and/or trench, also further explained below.

The macro adjustment mechanisms 80 can each comprise a connecting member 84 which is slidably connected to the main support 62 by a securing member 86 (FIG. 5). The connecting members 84 can be disposed on the main support 62 such that the connecting members 84 rest on the rails or lips 72 of the main support 62. For example, the connecting members 84 can be L-shaped.

The securing members 86 can each comprise a fastener 88 (e.g., a thumb screw, bolt, etc.) and a nut 90. The fastener 88 can be configured to extend vertically (i.e., in direction shown by arrow 74 in FIG. 5) through an opening (not shown) in the connecting member 84, between the rails 72 and into the groove 68 of the main support 62, and into the nut 90, as best shown in FIG. 5. The fasteners 88 and the nuts 90 can, for example, comprise corresponding threads. The nuts 90 can each be configured such that the nuts 90 cannot rotate relative to the main support 62 when the respective fasteners 88 are rotated relative to the main support 62. For example, the nuts 90 can each comprise a shape and a size that prevents such rotation. In the illustrated embodiment, for example, the nuts 90 comprises a generally rectangular shape and are sized such that the sides 76 of the main support 62 prevent the nuts 90 from rotating relative to the main support 62 when the fasteners 88 are rotated relative to the main support 62. It will be appreciated by those of ordinary skill in the art, however, that the nuts 90 can be prevented from rotating in various other ways, such as by including biasing elements (e.g., a spring) which are configured to prevent rotation of the respective nuts 90 relative to the main support 62 when the fasteners 88 are rotated relative to the main support 62.

In this manner, the first positioning members 64 can each be configured to move from an unlocked or loosened state to a locked or tightened state, or vice versa. For example, the first positioning members 64 can each be locked by rotating the respective fasteners 88 relative to the main support 62 in a first direction (i.e., the direction shown by arrow 92 (FIG. 4)), which urges the respective connecting member 84 against main support 62, thereby compressively locking the first positioning members 64 in place, relative to the main support 62. On the other hand, rotating the fasteners 88 relative to the main support 62 in a second direction (i.e., opposite the direction shown by arrow 92), releases the pressure between the connecting members 84 and the main support 62, thereby allowing the first positioning members 64 to slide (i.e., in the direction shown by arrow 70) and/or rotate, relative to the main support 62. Such rotation of the fasteners 88 can be accomplished by a person using their hand, but such person may also use a tool, such as a pliers or a wrench.

The micro adjustment mechanisms 82 can each comprise a fastener 94 which extends through and is adjustably connected to the connecting member 84, as best shown in FIG. 4. The micro adjustment mechanisms 82 can, for example, be adjustably connected to the respective connecting members 84 by forming an opening (not shown) in the connecting members 84 which comprises internal threads which correspond to external threads of the respective fasteners 94.

With reference to FIG. 4, the second positioning members 66 can each comprise an anchor receiving member 96 and at least one positioning retention member 98 (two in the illustrated embodiment). The anchor receiving members 96 can each be fixedly secured or coupled to the sides 76 of the main support 62. For example, the anchor receiving members can be welded to the sides 76 of the main support 62 near the ends 97, 99 of the main support 62. The second positioning members 66 can, for example, be used to adjust the vertical (i.e., the direction shown by arrow 74 in FIG. 5) positioning of the support bracket 16 and thus a channel section 12 relative to the anchors 18, as further described below.

With reference to FIG. 1, the anchor receiving members 96 can each be configured to be adjustably (e.g., slidably) connected to a respective anchor 18. For example, the anchor receiving members 96 can be elongate tubes through which the anchors 18 can be inserted, as best shown in FIG. 1. Referring now to FIG. 4, the receiving members 96 can comprise at least one circumferential opening (not shown) which is configured to adjustably receive a respective retention member 98. For example, the circumferential openings can comprise internal threads which correspond to external threads of the retention members 98.

The retention members 98 can each be configured to extend into the respective receiving members 96. In this manner, rotating the retention members 98 relative to the receiving members 96 in a first direction causes the retention members 98 to press against the respective anchors 18, thus securing the positioning of the receiving members 96 relative to the anchors 18. Conversely, rotating the retention members 98 relative to the receiving members 96 in the opposite direction causes the retention members 98 to retract from the respective anchors 18, thus allowing the receiving members 96 to move relative to the anchors 18.

When configured in this manner, for example, the support brackets 16 can be used to secure and position the channel sections 12 both relative to each other and to the anchors 18. For example, with the anchors 18 in securely positioned within a trench and/or the ground, the support brackets 16 can initially be connected to the anchors 18 by sliding the receiving members 96 over the respective anchors 18, as shown in FIG. 1. The positioning of the support brackets 16 can desirably selected by sliding the support brackets 16 vertically relative to the respective anchors 18. Once the desired positioning is achieved, the retentions members 98 can be tightened against the anchors 18 to secure the support brackets 16 in place relative to the anchors 18.

A channel section or a plurality of channel sections 12 can then be positioned on a respective support bracket 16 such that the channel section 12 is disposed between the first positioning members 64 of the support bracket 16, as shown in FIG. 1. With reference to FIG. 4, the micro positioning members 82 can each be advanced into the connecting members 84 such that a portion of each fastener 94 extends beyond the respective connecting member 84 (e.g., as best shown in FIG. 4) and contacts the sides 28 of the channel section 12, as shown in FIG. 1.

With reference to FIG. 1, with the channel section 12 secured between the first positioning members 64, macro or course horizontal adjustments can be made by unlocking or loosening the macro adjustment mechanisms 80 (FIG. 4) and moving the channel section 12 in the directions of arrow 70 (FIG. 4), relative to the main support 62. Once the desired horizontal positioning is achieved, the macro adjustment mechanisms 80 can be locked or tightened, thereby securing the horizontal positioning of the channel section 12 relative to the support bracket 16.

The micro adjustment mechanisms 82 can then be used to more precisely align the channel sections 12 in the horizontal direction, if desired. This can be accomplished by retracting the fastener 94 which is disposed in the direction in which the channel section 12 needs to be moved and by advancing the opposite fastener 94. For example, referring to FIG. 4, if a channel section 12 disposed between the first positioning members 64 needs to be moved to the right, the fastener **94*b* can be retracted such that a lesser portion of the fastener 94*b* extends to the left of the connecting member 84, and the fastener 94*a* can be advanced farther to the right in an amount equal to the amount which the fastener 94*b*** was retracted.

It should be noted that the steps above can be performed in any order. For example, the horizontal positioning can be performed first, and the vertical positioning can be performed second.

Figure 6:
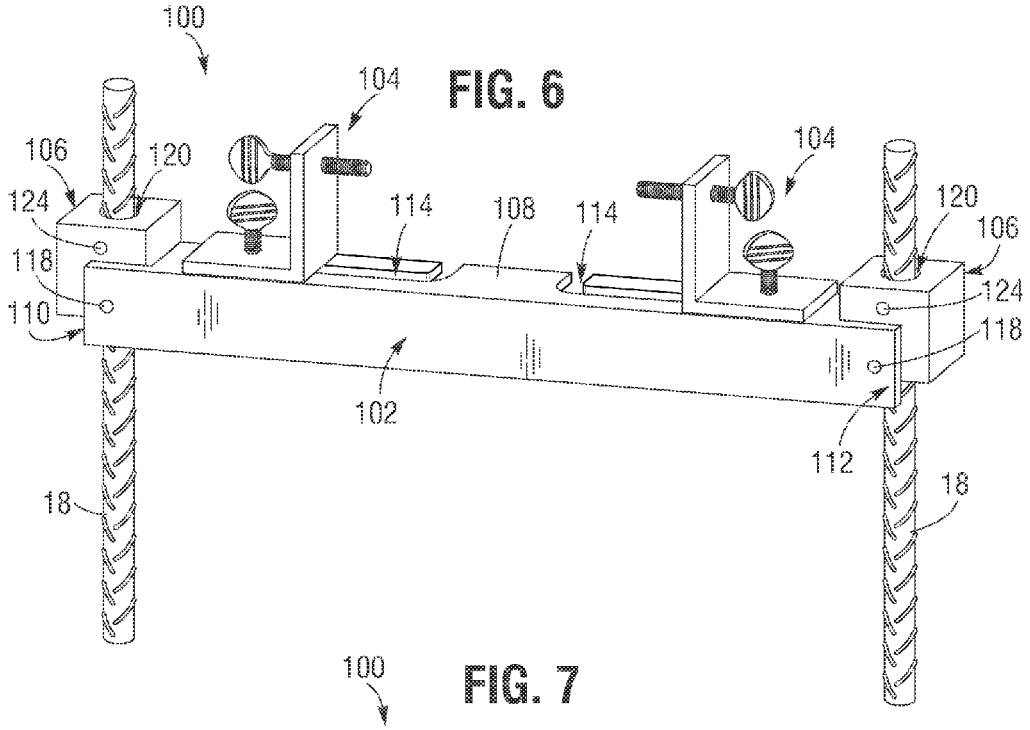
FIG. 6 is a perspective view of an exemplary channel support system, according to another embodiment.
Figure 7:
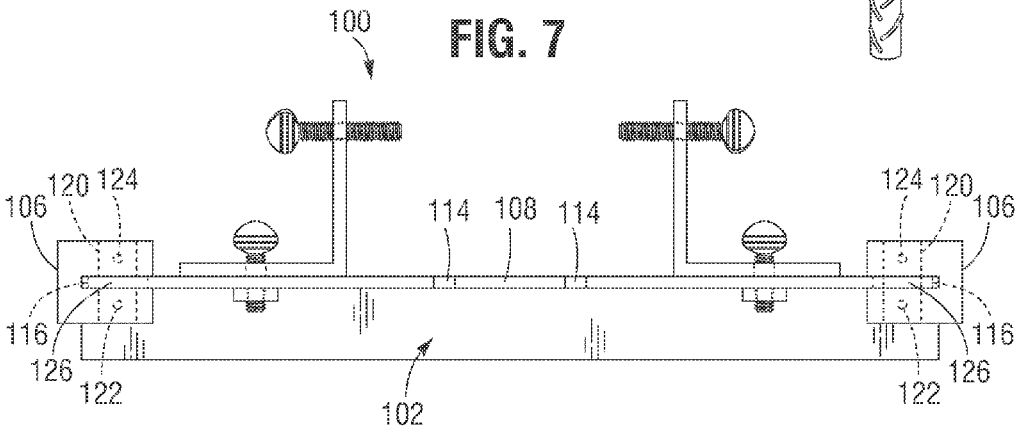
FIG. 7 is a side view of the channel support bracket of FIG. 6.
Figure 8:
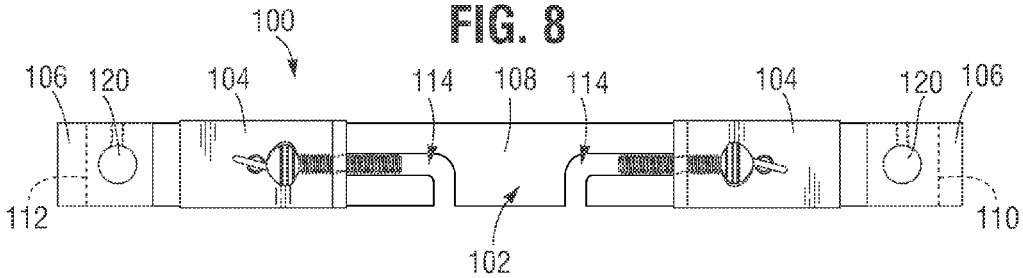
FIG. 8 is a top view of the channel support bracket of FIG. 6.

FIGS. 6-8 show an exemplary embodiment of a support bracket 100, similar to support bracket 16. The support bracket 100 can comprise a main support member 102, a plurality of first positioning members 104 (two in the illustrated embodiment), and a plurality of second positioning members 106 (two in the illustrated embodiment), as best shown in FIG. 6. The first positioning members 104 can each be disposed on and detachably, slidably, and/or rotatably connected to an intermediate portion 108 (i.e., the portion between the ends 110, 112) of the main support member 102, and the second positioning members 106 can each be disposed on and detachably connected to respective first and second ends 110, 112 of the main support member 102, as further described below.

The main support member 102 can comprise a plurality of grooves or slots 114 (two in the illustrated embodiment), a plurality of first openings 116 (FIG. 7) (two in the illustrated embodiment), and, optionally, a plurality of second openings 118 (FIG. 6) (two in the illustrated embodiment). The grooves 114 can each extend vertically through and along the intermediate portion 108 directed towards a respective end 110, 112, as best shown in FIG. 8. The first openings 116 can each be disposed near a respective end 110, 112 and extend vertically through the main support 102, as best shown in FIG. 7. The second openings 118 can each be disposed near a respective end 110, 112 and extend laterally through the main support 102, as best shown in FIG. 6.

The grooves 114 can be configured such that the first positioning members 104 and the main support 102 can interact and can be used in a manner similar to the first positioning members 64 and the main support 62 of the support bracket 16. For example, the first positioning member 104 can be used to adjust both the macro and micro horizontal positioning of a channel section (e.g., channel section 12), relative the support bracket 100.

The openings 116 can be configured such that anchors 18 can extend through the main support member 102, as shown in FIG. 6. In some embodiments, as shown in FIG. 7, the openings 116 can comprise a larger diameter than the diameter of vertically extending first openings 120 in the each of the second positioning members 106.

This configuration allows the support member 102 to be used with anchors of various diameter by interchanging the second positioning members 106. For example, the openings 116 can be configured to accommodate up to #6 (i.e., ¾ in. diameter) rebar. Thus, in some embodiments, for example, the main support can be used with #6 rebar anchors by providing a second positioning member that is configured to accommodate #6 rebar. In other embodiments, for example, the same main support 102 can be used with #4 (i.e., ½" diameter) rebar.

With reference to FIG. 6, when using the main support 102 with anchors 18 and thus second positioning members 106 that comprise a smaller diameter than the openings 116, a respective fastener (not shown) (e.g., a screw, a bolt, a rivet, etc.) can be inserted through each opening 118 and into a respective second opening 122 in each of the second positioning members 106 to maintain the positioning of the second positioning members relative to the main support 102. However, when using the main support 102 with anchors 18 and thus second positioning members 106 that comprise the same diameter as the openings 116, the fasteners are not required because the anchors 18 will maintain the positioning of the second positioning members relative to the main support 102.

The main support 102 can be formed from various materials, including steel, aluminum, polymers, etc. The main support member 102 can comprise various dimensions to correspond to a particular channel section size or range of sizes with which the support bracket 100 is to be used.

The main support 102 can, for example, be formed from an elongate tube, channel, plate, etc. For example, as shown in the illustrated embodiment, the main support 62 can be formed from angle iron.

The first positioning members 104 can be configured and function in a manner substantially similar to the first positioning members 64 of the support bracket 16.

In addition to the first and the second openings 120, 122, the second positioning members 106 can further comprise third openings 124 and a laterally extending groove or slot 126. As best shown in FIG. 7, the third openings 124 can be tap holes which each extend into a respective opening 120. A fastener (not shown) can be inserted through each of the third openings 124 to secure the positioning of the second positioning members 106 relative to the anchors 18, in a manner similar to the fasteners 98 of the support bracket 16. The slots 126 can be configured such that the second positioning members 106 can be inserted over a respective end 110, 112 of the main support, as best shown in FIG. 7. The slots 126 can prevent the second positioning members 106 from moving vertically relative to the main support 102.

The second positioning members 106 can be formed from various materials, including steel, aluminum, polymers, etc. The second positioning members 106 can comprise various dimensions to correspond to a particular support bracket 100 is to be used. In some embodiments, the first openings 120 can be configured to accommodate a particular anchor size. In other embodiments, the first openings 120 can be configured to accommodate various anchor sizes and an adapter or insert (e.g., a shim) can be provided for the particular application.

In use, the support bracket 100 can function in a manner substantially similar to support bracket 16. For example, the support bracket 100 comprises both macro and micro adjustment in a first direction (e.g., horizontal in the orientation shown in FIG. 6) via the first positioning members 104, as well as adjustment in a second direction (e.g., vertical in the orientation shown in FIG. 6) via the second positioning members 106.

Figure 9:
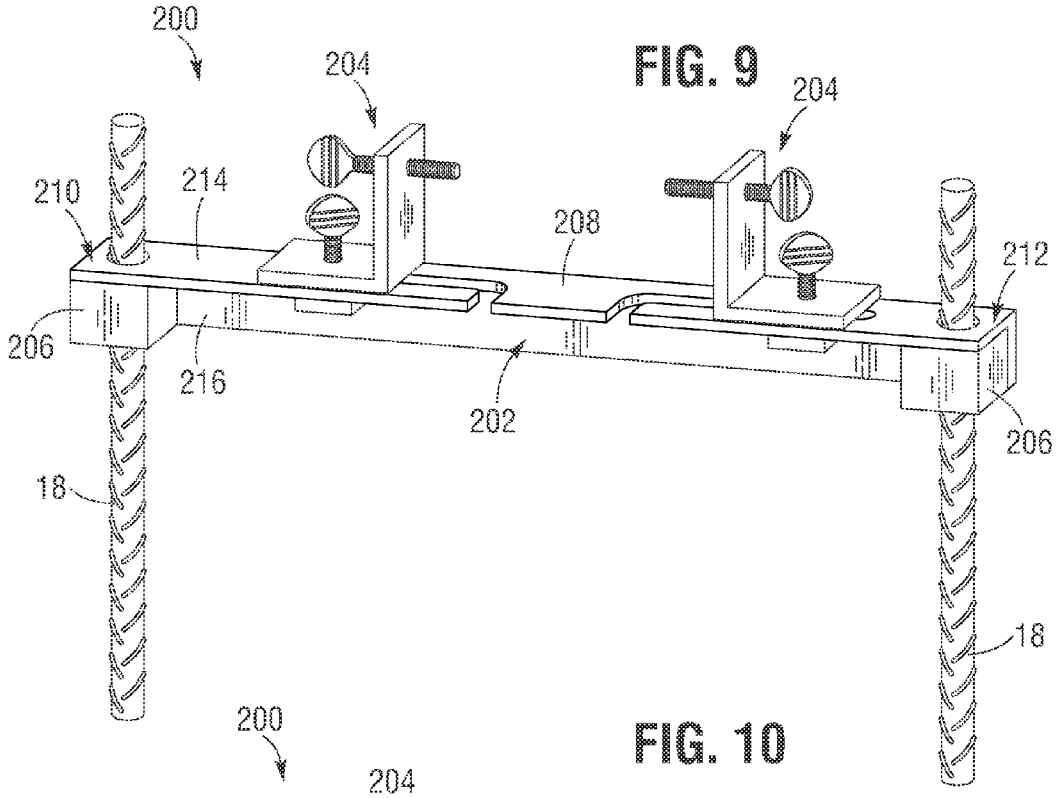
FIG. 9 is a side, perspective view of an exemplary embodiment of a channel support bracket, according to another embodiment.
Figure 10:
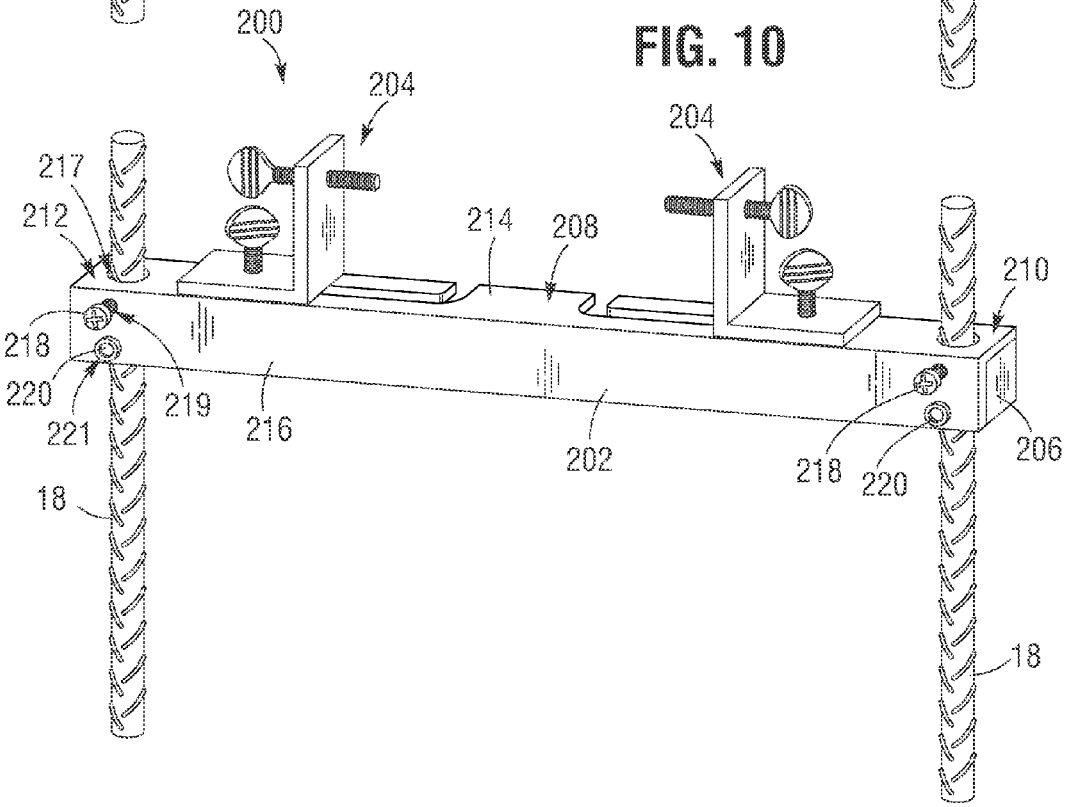
FIG. 10 is another side, perspective of the channel support bracket of FIG. 9.

FIGS. 9-10 show an exemplary embodiment of a support bracket 200, similar to support bracket 100. The support bracket 200 can comprise a main support member 202, a plurality of first positioning members 204 (two in the illustrated embodiment), and a plurality of second positioning members 206 (two in the illustrated embodiment), as best shown in FIG. 9. The first positioning members 204 can each be disposed on and detachably connected to an intermediate portion 208 (i.e., the portion between the ends 210, 212) of the main support member 202, and the second positioning members 206 can each be disposed on and detachably connected to respective first and second ends 210, 212 of the main support member 202, as further described below.

As shown, the main support 202 and the first positioning members 204 are substantially similar to the main support and first positioning members 102, 104 of the support bracket 100. As such, the main support 202 and the first positioning members 204 can be connected together and function in a manner similar as described above with respect to support bracket 100.

The second positioning members 206 can each comprise a generally cuboid shape such that the second positioning members 206 be disposed between a first portion 214 (i.e., the upper, horizontally oriented portion in the illustrated embodiment) and a second portion 216 (i.e., the lower, vertically oriented portion in the illustrated embodiment). Positioning the second positioning members 206 in this manner allows the main support 202 to help maintain the orientation of the second positioning members 206 because the second positioning members 206 can be configured to fit snugly between the first and second portions 214, 216. This positioning also helps to conceal and/or protect the second positioning members 206, which in turn can improve the functionality and/or the aesthetics of the support bracket 200.

The second positioning members 206 can each comprise a plurality of openings (three in the illustrated embodiment). Central openings 217 can extend vertically through each of the second positioning members 206. The central openings 217 can allow an anchor 18 to pass through each of the second positioning members 206, as shown in the embodiment illustrated FIG. 9. In some embodiments, the central openings 217 can be configured to accommodate a particular anchor size. In other embodiments, the central openings 217 can be configured to accommodate various anchor sizes and an adapter or insert (e.g., a shim) can be provided for the particular anchor size being used.

Adjustment openings 219 can each extend laterally and perpendicularly from an end surface into the central opening. The adjustment openings 219 can be used to adjust the positioning of the second positioning members 206, and thus the support bracket 200, relative to the anchors 18. This can be accomplished, for example, by inserting a fastener 218 (e.g., a screw, a bolt, etc.) through the second portion 216 of the main support and through the adjustment opening such that the fastener 218 contacts the anchor 18, as shown in FIG. 10.

Connection openings 221 can each be spaced apart from and extend parallel to the adjustment openings. The connection openings 221 can be used to maintain the positioning of each of the second positioning members 206 relative to the main support 202. This can be accomplished, for example, by inserting a fastener 220 (e.g., a rivet, a screw, a bolt, etc.) through the second portion 216 of the main support 202 and into the connection opening 221, as shown in FIG. 10.

In use, the support bracket 200 can function in a manner substantially similar to support bracket 16. For example, the support bracket 200 comprises both macro and micro adjustment in a first direction (e.g., horizontal in the orientation shown) via the first positioning members 204, as well as adjustment in a second direction (e.g., vertical in the orientation shown) via the second positioning members 206.

Figure 11:
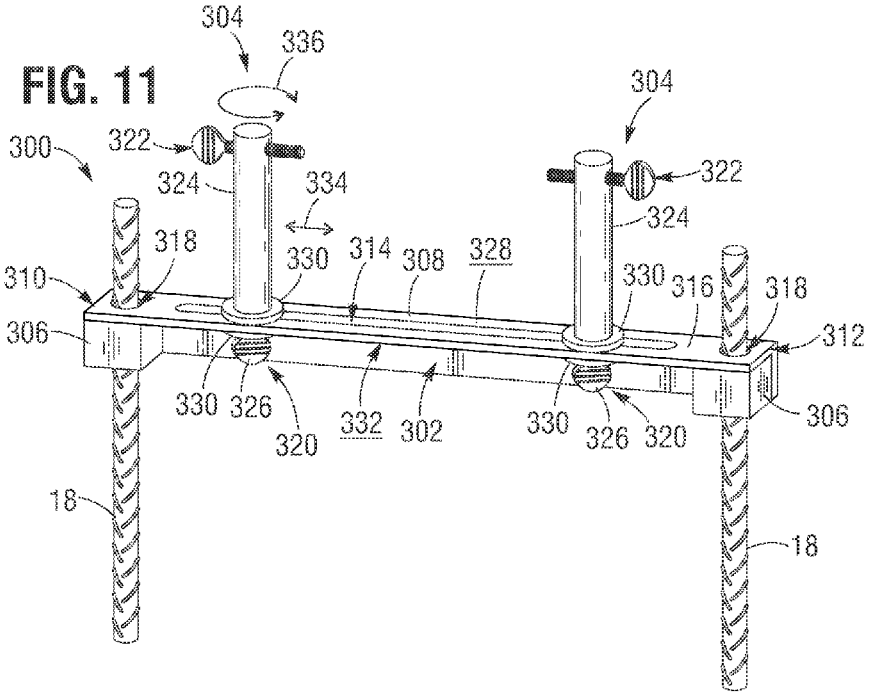
FIG. 11 is a perspective view of another exemplary embodiment of a channel support bracket.
Figure 12:
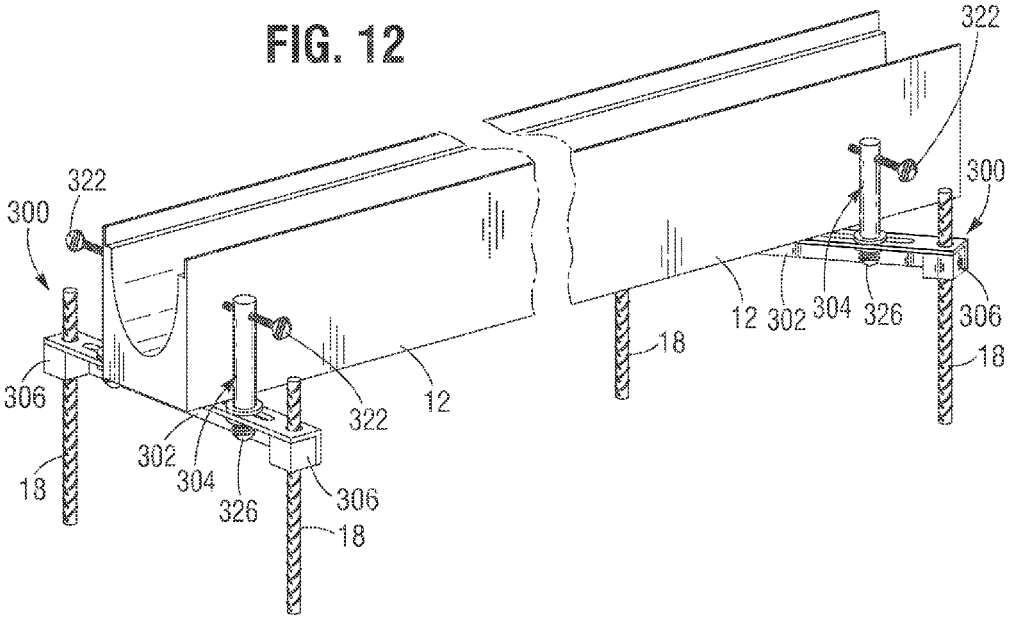
FIG. 12 is a perspective view of a plurality of the channel support brackets of FIG. 11 being used to support a trench drain channel.

FIGS. 11-12 show an exemplary embodiment of a support bracket 300, similar to support bracket 200. The support bracket 300 can comprise a main support member 302, a plurality of first positioning members 304 (two in the illustrated embodiment), and a plurality of second positioning members 306 (two in the illustrated embodiment), as best shown in FIG. 11. The first positioning members 304 can each be disposed on and detachably connected to an intermediate portion 308 (i.e., the portion between the ends 310, 312) of the main support member 302, and the second positioning members 306 can each be disposed on and detachably connected to respective first and second ends 310, 312 of the main support member 302, as best shown in FIG. 11.

The main support 302 can comprise a groove 314 which extends through and longitudinally along a first portion 316 (i.e., the upper, horizontally oriented portion in the illustrated embodiment) of the main support 302. Through the groove 314, each of the first positioning members 304 can be detachably connected to the main support 302. The groove 314 can also allow each of the first positioning members 304 to slide and or rotate relative to the main support 302.

It should be noted that any of the support brackets described herein can comprise a single groove (e.g., support brackets 300, 400, 600) or more than one groove (e.g., support brackets 16, 100, 200, 500) in which the first positioning member or members can traverse, even though the particular embodiment is shown as having one groove or shown as having multiple grooves.

The main support 302 can further comprise anchor openings 318 which extend through the first portion 316 near the respective ends 310, 312 of the main support 302. The anchor openings 318 can allow the anchors 18 to pass through the main support 302, and in conjunction with the second positioning members 306, can be used to adjust the positioning of the main support 302 relative to the anchors 18.

The first positioning members 304 can each comprise a macro adjustment mechanism 320 and a micro adjustment mechanism 322, as best shown in FIG. 11. The macro adjustment mechanisms 320 can each be detachably, slidably, and rotatably connected to the main support 302, and the micro adjustment mechanisms 322 can each be adjustably connected to a respective macro adjustment mechanism 320, as further described below. The first positioning members 304 can be used to secure a respective channel section 12 to a respective support bracket 300 and/or to position the channel section 12 relative to the support bracket 300 and thus the anchors 18 and/or trench, as best shown in FIG. 12.

As shown in FIG. 11, the macro adjustment mechanisms 320 can each comprise a connecting member 324 and a fastener 326 (e.g., a thumb screw, bolt, etc.). The connecting member 324 can disposed on a first surface 328 (i.e., the upper surface) of the first portion 316 of the main support 302. This can be accomplished by configuring the connecting members 324 such that they laterally extend beyond the groove 314 and/or washers 330 can be provided to prevent the connecting members 324 from extending into the groove 314. The fasteners 326 can be disposed on a second surface 332 (i.e., the bottom surface of the first portion 316 of the main support 302) and extend through the groove 314 and into a respective connecting member 324. The fasteners 326 can each be configured such that a portion (e.g., the head) of the fastener 326 cannot extend through the groove 314 and/or washers 330 can be provided to prevent the entire fastener 326 from extending into and/or through the groove 314.

The connecting members 324 and the fasteners 326 can comprise complementary threads such that the fasteners 326 can be used to secure and/or release the connecting members 324, and thus the first positioning members 304, relative to the main support 302. For example, the connecting members 326 can comprise an opening with internal threads which correspond to external threads of the fasteners 324.

In this manner, the first positioning members 304 can be locked or secured in place relative to the main support 302 by rotating the fasteners 326 in a first direction, and the first positioning members 304 can be unlocked or released relative to the main support 302 by rotating the fasteners 326 in the opposite direction. In the locked state, the first positioning members 304 cannot slide longitudinally and/or rotate axially relative to the main support 302 (e.g., in the directions shown by arrows 334, 336 in FIG. 11, respectively). However, the first positioning members 304 can slide longitudinally and/or rotate relative to the main support 302 in the unlocked state.

With reference to FIG. 12, because the first positioning members 304 are rotatable relative to the main support 302, the first positioning members can be rotated such that the first positioning members are substantially perpendicular relative to a channel section 12 even if the main support 302 is not substantially perpendicular relative to the channel section 12, as shown in FIG. 12. This feature allows the support bracket 300 to be used in a wide variety of situations in which a typical support bracket could not be used.

It should also be noted that any of the support brackets described herein comprise first positioning members which are rotatable relative to their respective main supports. Thus, any of the support brackets described herein can be used when the main support is non-perpendicular to a channel section (e.g., FIG. 12)

As best shown in FIG. 11, the connecting members 324 can, for example, have a generally cylindrical shape. The cylindrical shape allows the connecting members 324 to remain aligned with the main support 302 when the main support 302 is angled in a non-perpendicular manner relative to a channel section (FIG. 12). In alternative embodiments, the connecting members 324 can comprise various other shapes, such as rectangular.

The other components of the support bracket 300 (e.g., the second positioning member 306 and micro adjustment mechanism 322 can be configured and function similarly to as described above with respect to the other support brackets (e.g., support bracket 16 and support brackets 200). Thus, the support bracket 300 can be used in conjunction with channel sections (e.g. channel sections 12) and frames (e.g., frames 14).

Figure 13:
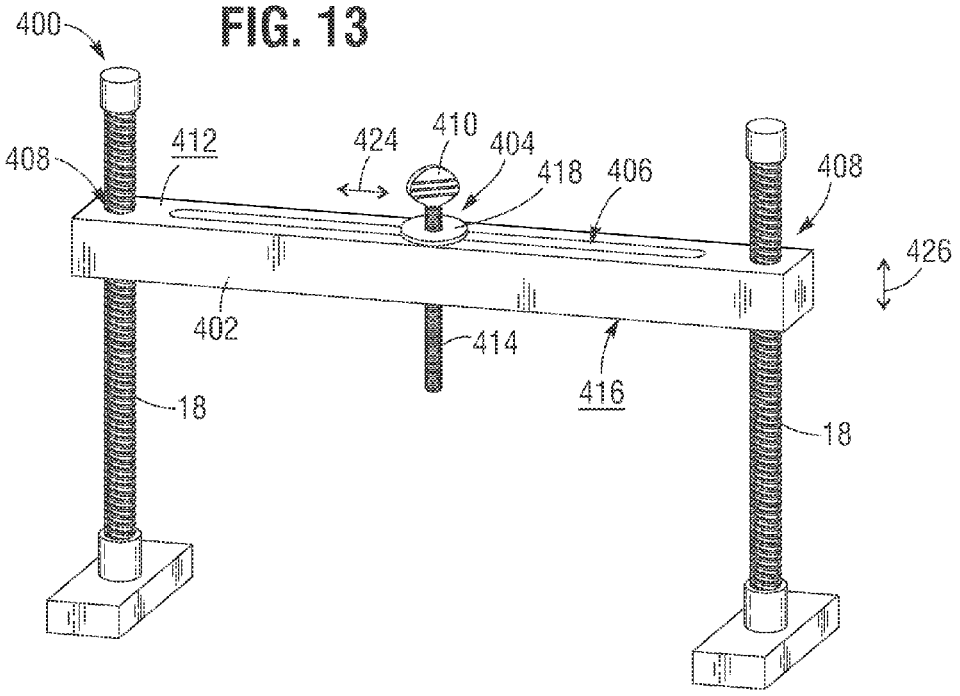
FIG. 13 is a perspective view of another exemplary embodiment of a channel support bracket.
Figure 14:
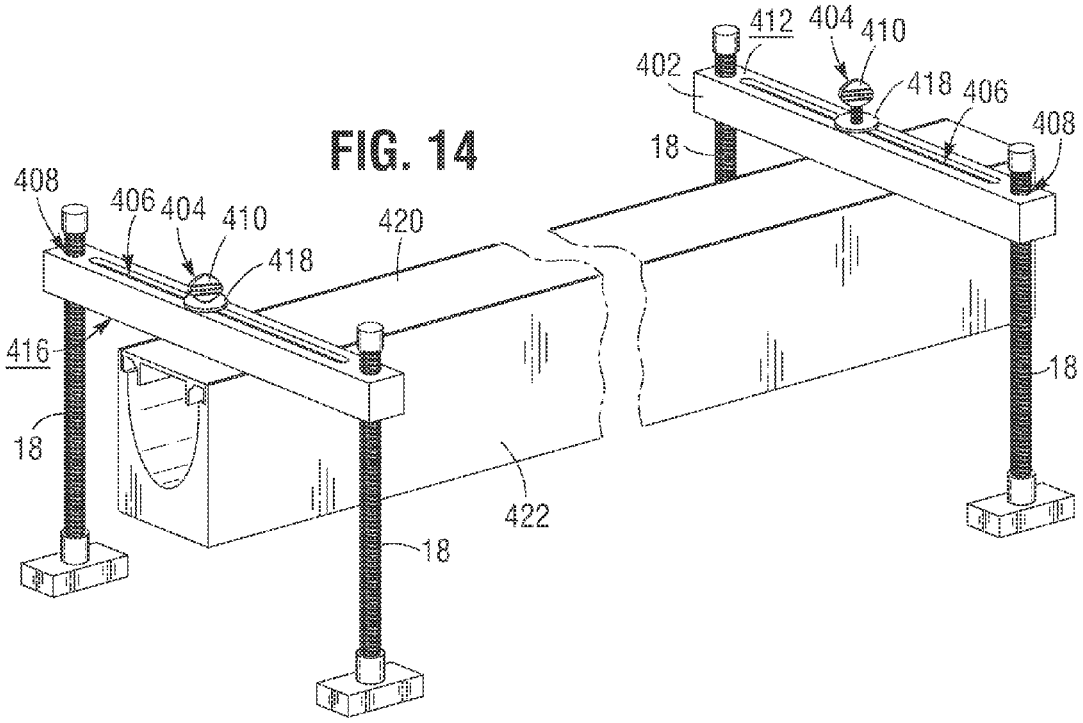
FIG. 14 is a perspective view of a plurality of the channel support brackets of FIG. 13 being used to support a trench drain channel.

FIGS. 13-14 show an exemplary support bracket 400, according to one embodiment. The support bracket 400 can comprise a main support 402 and a fastener 404, as best shown in FIG. 13. The main support 402 can be adjustably connected to support bracket 400 to anchors 18, and the fastener 404 can be used to connect the support bracket to a channel section 12, as best shown in FIG. 14.

The main support 402 can comprise a longitudinally extending groove 406 and a plurality of vertically extending anchor openings 408. The groove 406 can be configured such that the fastener 404 can extend vertically through the groove 406, thus allowing the fastener 404 to be detachably and slidably connected to the main support 402. The anchor openings 408 can allow the anchors 18 to pass through the main support 402 and can be used to adjust the positioning of the main support 402 relative to the anchors 18. The anchor openings 408 can, for example, comprise internal threads which correspond to external threads of the anchors 18, as shown.

The fastener 404 can be configured such that a head portion 410 is disposed on or extends vertically above a first surface 412 (i.e., the top surface of the main support 402) and a connecting portion 414 extends vertically below a second surface 416 (i.e., the bottom surface of the main support 402), as best shown in FIG. 13. The head portion 410 can be sized or otherwise configured such that it cannot extend through the groove 406, and/or washers 418 can be used for this purpose.

The connecting portion 414 of the fastener 404 can be configured to engage a frame 420 (similar to frame 14) and/or a cross-brace (similar to cross-brace 32) of a channel section 422, as shown in FIG. 14. For example, the frame 420 can comprise an opening (similar to opening 42) through which the connecting portion 414 can extend. In some embodiments, the opening in the frame can comprise internal threads which correspond to external threads of the connecting portion 414. In addition to or in lieu of the opening in the frame 420 having internal threads, the cross-brace of the channel section 422 can comprise internal threads which correspond to the external threads of the connecting portion 414.

As such, the groove 406, in conjunction with the fastener 404, can be used to adjust the positioning of the channel section 420 relative to the support bracket 400 in a first, horizontal direction (i.e., the direction shown by arrow 424). For example, the fastener 404 can be initially inserted into the frame 420 such that the fastener 404 is not fully tightened (i.e., some of the connection portion 414 extends above the first surface 412 (e.g., as shown by the right-most fastener 404 in FIG. 14) and/or there is a gap between the second surface 416 of the main support 402 and the frame 420)). In this configuration, the channel section 422 is connected to the support bracket 400 and the fastener 404 can freely slide within the groove 406. Once the channel section 422 is desirably positioned horizontally, the channel section 422 can be locked in place by rotating the fastener such that the channel section 422 and/or the frame 420 contacts and is sufficiently compressed against the second surface 416 (e.g., as shown by the left most fastener 404 in FIG. 14).

The anchor openings 408 can be used to adjust the positioning of the channel section 422 relative to the support bracket 400 in a second, vertical direction (i.e., the direction shown by arrow 426). For example, the vertical positioning can be adjusted by rotating a respective anchor 18 relative to the main support 402, or vice versa.

Configuring a support bracket such that it connects to an upper portion of a channel section, for example, as shown by support bracket 400 in FIG. 14, allows the bracket to be reusable because the bracket is not lost in the concrete pour. The bracket is not lost in the pour because it does not attach to a portion of the channel section that is covered by the concrete or other fill material. As such, the bracket can be attached to the channel section during installation and can then be removed once the concrete or other fill material is sufficiently stable and/or otherwise capable of supporting the channel section. Thus, configuring the support bracket such that it can be attached to the upper portion of a channel section significantly reduces the cost of installing a trench drain system and reduces the environment impact of the installation because the support bracket can be reused.

Figure 15:
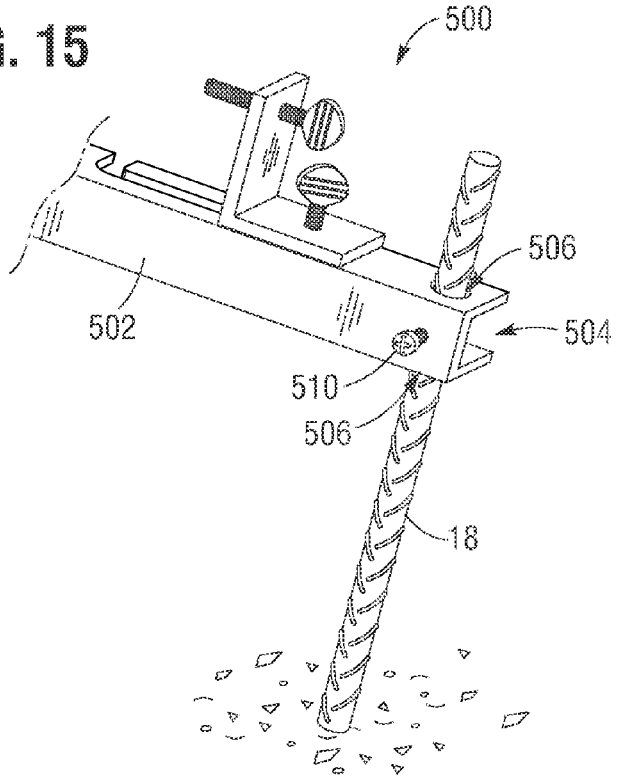
FIG. 15 is a partial perspective view of another exemplary embodiment of a channel support bracket.

FIG. 15 shows an exemplary support bracket 500, according to one embodiment. The support bracket 500 comprises a main support 502 and a second positioning member 504. As shown, the second positioning member can be integrally formed with the main support 502. For example, the main support 502 can be formed from a U-shaped piece of material which has two vertically extending openings 506 on each side of the main support 502 which allow anchors 18 to be slidably connected to the main support 502. A fastener 510 can be provided to secure the positioning of the main support 502 relative to the anchor, as described above. The support bracket 500 can otherwise be configured and function in a manner substantially similar to support bracket 200.

Figure 16:
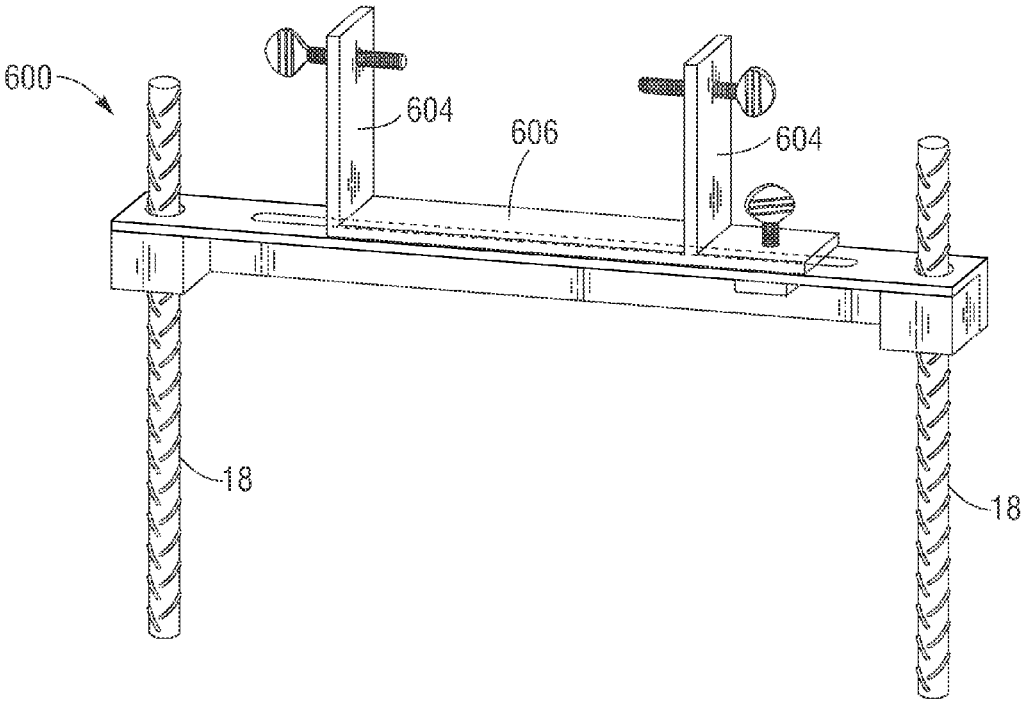
FIG. 16 is a perspective view of an exemplary channel support bracket, according to another embodiment.

FIG. 16 shows an exemplary embodiment of a support bracket 600, similar to support bracket 200. As shown, the support bracket 600 comprises only one first positioning member 602 rather than a plurality. As shown, the first positioning member comprises a plurality of connecting members 604 which are connected by a cross-member 606. The support bracket 600 can otherwise be configured and function in a manner substantially similar to support bracket 200.

Figure 17:
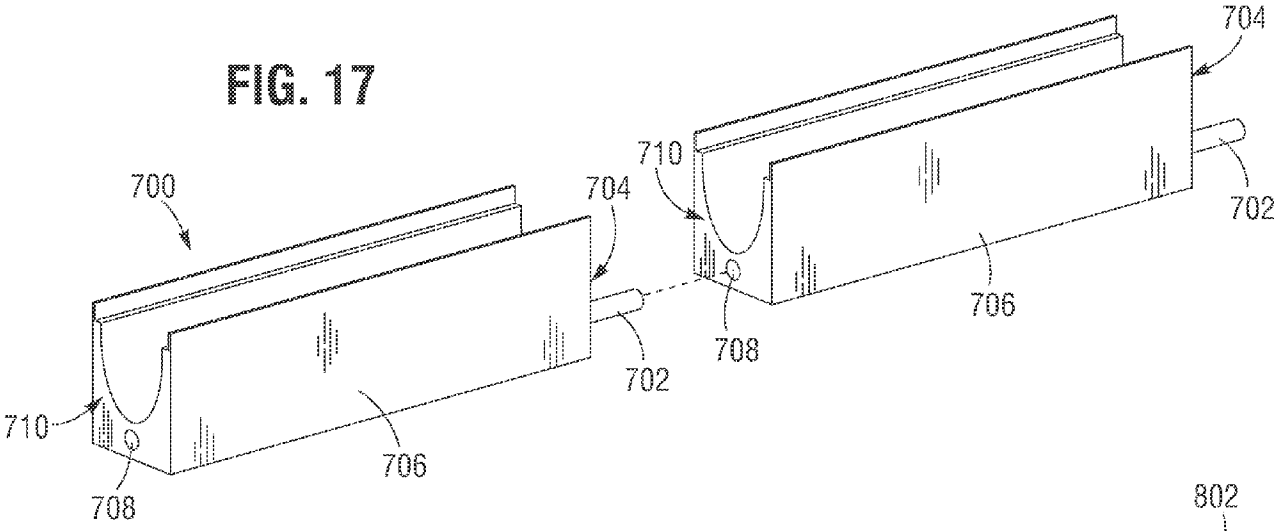
FIG. 17 is a perspective view of an exemplary trench drain system comprising a frame, according to another embodiment.

FIG. 17 shows another exemplary embodiment of a trench drain system 700 comprising frames 702 which function substantially similar to the frames 14 of trench drain system 10. As shown, the frames 702 can be connected to and extend from first ends 704 of respective channel sections 706. The channel sections 702 can each comprise respective receptacles or openings 708 which are disposed on second ends 710 (i.e., the second ends being diametrically opposite from the first ends) of the channels 702. The receptacles 708 can each be configured such that a respective frame 702 can be inserted into the receptacle, thereby aligning and connecting the channel sections.

In some embodiments, the frames 702 can, for example be detachably connected to the respective channel sections, such as be fasteners, couplers, etc. In alternative embodiments, the frames 702 can be integrally formed with the respective channel sections. In any event, the frames 702 can provide substantially similar benefits to the benefits described above with respect to the frames 14.

Figure 18:
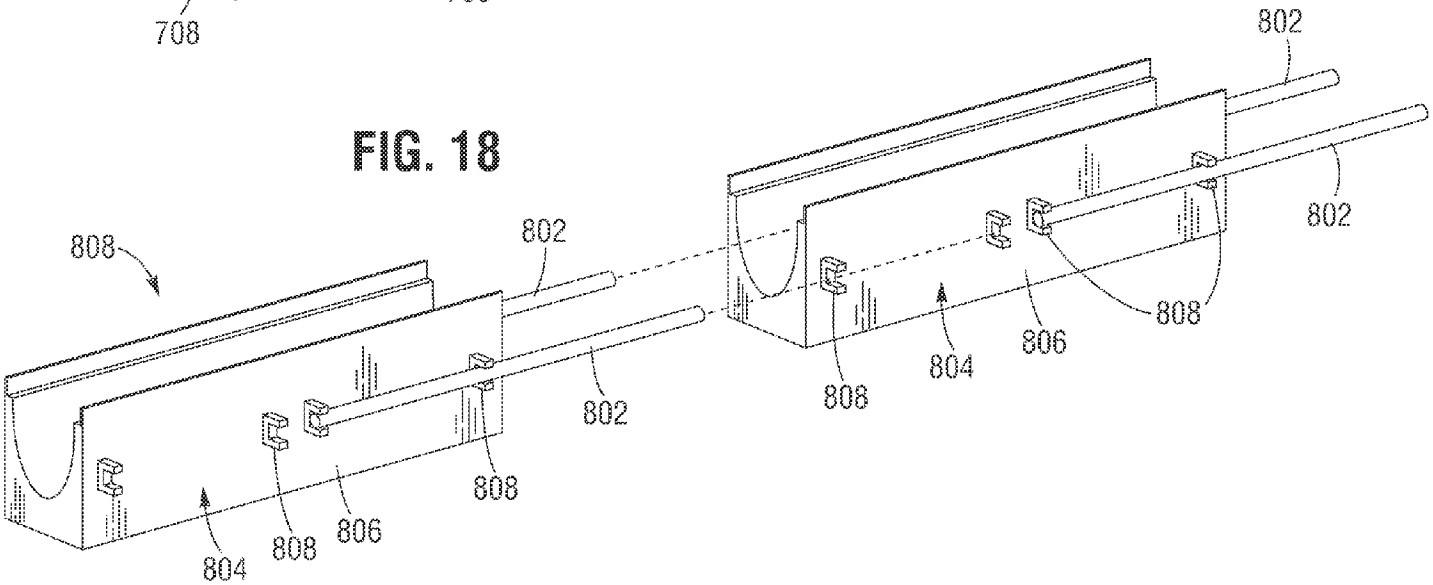
FIG. 18 is a perspective view of an exemplary trench drain system comprising a frame, according to another embodiment.

FIG. 18 shows yet another exemplary embodiment of a trench drain system 800 comprising frames 802 which function substantially similar to the frames 14 of trench drain system 10. As shown, the frames 802 can extend along and be detachably connected to the sides 804 of the respective channel sections 806.

The frames 802 can, for example, be detachably connected to the sides 804 with couplers 808, as shown in the illustrated embodiment. It will be appreciated by one of ordinary skill in the art that the frames 802 can be detachably connected to the sides 804 in various other ways, such as with fasteners.

The frames 802 can provide substantially similar benefits to the benefits described above with respect to the frames 14.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A support bracket for use in a trench drain system comprising:

a support member configured to support at least a portion of a trench drain channel section;

a first positioning member connected to the support member, wherein the first positioning member is configured to adjustably move and secure the at least a portion of a trench drain channel section in a lateral direction relative to the support member and relative to at least one anchor when the at least a portion of a trench drain channel section is secured to the first positioning member; and a second positioning member configured to adjustably move and secure the at least a portion of a trench drain channel section in a vertical direction relative to the at least one anchor.

2. The support bracket of claim 1, wherein the first positioning member comprises at least one securing element for securing the at least a portion of a trench drain relative to the first positioning member, and the first positioning member is slidably connected to the support member such that when the at least a portion of a trench drain is secured relative to the first positioning member by the at least one securing element, the at least a portion of a trench drain is slidable relative to the at least one anchor.

3. The support bracket of claim 2, wherein the support member includes at least one laterally extending groove along which the first positioning member can slide and which is aligned with first and second anchors.

4. The support bracket of claim 1, wherein the first positioning member comprises a tube portion that extends from the support member in a vertical direction and is rotatably connected to the support member and is rotatable relative to the at least one anchor.

5. The support bracket of claim 1, wherein the support member comprises a first end portion and an opposing second end portion, and the first positioning member comprises a first side portion disposed on the first end portion of the support member and a second side portion disposed on the second portion of the support member and comprises a plurality of first fasteners coupled to the first and second side portion and that extend in the first direction and a plurality of second fasteners that extend in a vertical direction.

6. The support bracket of claim 1, wherein the first positioning member comprises first and second adjustment mechanisms, wherein the first adjustment mechanism is configured to secure the at least a portion of the trench drain channel section relative to the first positioning member in an secured state, and the second adjustment mechanism is configured to move the at least a portion of the trench drain channel section in the lateral direction relative to the support member and the at least one anchor when the first adjustment mechanism is in the secured state.

7. The support bracket of claim 1, wherein the support bracket is configured to attach to an upper portion of the trench drain channel section.

8. The support bracket of claim 1, wherein at least a portion of a trench drain channel section directly contacts both the support member and the first positioning member.

9. The support bracket of claim 1, wherein the second positioning member is fixedly secured to the support member.

10. The support bracket of claim 1, wherein the second positioning member is detachably connected to the support member.

11. The support bracket of claim 1, wherein the support member and the second positioning member are integrally formed from a single piece of material.

12. The support bracket of claim 1, wherein the first direction is substantially parallel to a plane of the ground adjacent to the support bracket and the second direction is substantially perpendicular to the plane of the ground adjacent to the support bracket.

13. A trench drain system comprising:

a plurality of channel sections, wherein the channel sections each comprise a trough having a top opening which is disposed between upper edges which extend longitudinally along each side of the channel sections;

an elongate frame, wherein the elongate frame comprises a closed upper surface which is configured to extend longitudinally over one or more of the channel sections and to extend laterally between the upper edges of the channel sections such that the top opening of the trough is covered; and one or more support brackets having a first positioning member and a second positioning member, wherein the first positioning member includes both a macro and a micro adjustment mechanism which are each configured to move and secure at least a portion of one of the channel sections in a first direction, and wherein the second positioning member is configured to move and secure the at least a portion of one of the channel sections in a second direction.

14. The trench drain system of claim 13, wherein the channel sections further comprise a cross-brace which is configured to receive a fastener which extends to the cross-brace from the elongate frame.

15. The trench drain system of claim 13, wherein the elongate frame further comprises laterally spaced-apart, longitudinally extending outer rails, which are disposed between the outer rails, and a plurality of primary openings in the upper surface, the plurality of primary openings being configured to receive a fastener.

16. The trench drain system of claim 13, wherein the support bracket further comprises a main support member having a groove in which the first positioning member slides.

17. A method of aligning a second trench drain channel section relative to an adjacent first trench drain channel section comprising:

positioning the second trench drain channel section on one or more support brackets in an initial position;

securing the second trench drain channel section to the one or more support brackets with a first adjustment mechanism of the one or more support brackets;

subsequent to the act of securing the second trench drain channel section to the one or more support brackets, moving the second trench drain channel section in a first direction from the initial position to a first position by adjusting a second adjustment mechanism of the one or more support brackets;

securing the second trench drain channel section in the first position with a second adjustment mechanism of the one or more support brackets such that the second trench drain channel section cannot move in the first direction relative to an anchor; and moving the second trench drain channel section in a second direction from the first position to a second position by adjusting a third adjustment mechanism of the one or more support brackets.

* * * * *